United States Patent [19]

Cruse, Jr. et al.

[11] 4,032,123

[45] June 28, 1977

[54] SHAFT FURNACE FOR DIRECT REDUCTION OF ORES

[75] Inventors: Clyde L. Cruse, Jr., Middletown, Ohio; Joe H. Brown, Houston, Tex.

[73] Assignee: Armco Steel Corporation, Middletown, Ohio

[22] Filed: Oct. 15, 1976

[21] Appl. No.: 732,885

[52] U.S. Cl. ..... 266/186; 266/197

[51] Int. Cl.[2] ..... C21B 11/00

[58] Field of Search ..... 75/5, 7, 33–36; 266/144, 156, 168, 171, 176, 177, 186, 187, 189, 197

[56] References Cited

UNITED STATES PATENTS

| | | | |
|---|---|---|---|
| 196,056 | 10/1877 | Taylor | 75/7 |
| 3,063,695 | 11/1962 | De Vaney | 266/156 |

*Primary Examiner*—Gerald A. Dost

*Attorney, Agent, or Firm*—Melville, Strasser, Foster & Hoffman

[57] ABSTRACT

A gravity feed shaft furnace for direct reduction of iron ores having substantially cylindrical reducing and cooling zones, an inwardly tapering discharge zone of ellipsoidal cross section, an elongated substantially cylindrical member disposed axially within the furnace extending upwardly through the discharge and cooling zones to terminate in the reducing zone, a conical top secured to the elongated member and configured to cause uniform downward solids flow, and means for introducing hot reducing gas and cooling gas into the elongated member. Means are provided for distributing the hot reducing gas into the center of the reducing zone, for distributing the cooling gas into the center of the cooling zone, and for causing part of the cooling gas to cool the hot reducing gas distribution means.

9 Claims, 8 Drawing Figures

SHAFT FURNACE FOR DIRECT REDUCTION OF ORES

BACKGROUND OF THE INVENTION

1. Field of the Invention

This invention relates to a gravity feed shaft type furnace for the direct reduction of sized or pelletized iron ores wherein iron ore is fed into the top of a shaft furnace and descends therethrough by gravity for reduction at elevated temperatures by a strongly reducing gaseous atmosphere in a reducing zone, followed by cooling in a non-oxidizing atmosphere in a cooling zone of the furnace, and discharged from the lowermost end of the furnace at a temperature not exceeding about 95° C. More specifically, the invention provides structure which insures uniform solids flow, and simultaneously improves distribution of cooling gas into the cooling zone and distribution of hot reducing gas into the reducing zone of a shaft furnace of the type described above.

The invention has particular utility in the reduction of pelletized and/or sized iron ore particles ranging between about three-eighths inch and 1½ inches (9.5 and 38 mm) in diameter. For convenience the term "sized ores" will be used hereinafter to designate both beneficiated and pelletized iron ores, and ores which have been comminuted and subjected to a screening operation for separation of desired particle sizes.

2. Description of the Prior Art

Reference may be made to the following United States patents as illustrative of the present state of the art:

| | |
|---|---|
| 3,876,189 | 3,591,158 |
| 3,836,131 | 3,450,396 |
| 3,764,123 | 2,931,720 |
| 3,749,386 | (and divisional 3,063,695) |
| | 2,873,183 |

The provision of an axial, centrally disposed member within a shaft furnace is disclosed in U.S. Pat. Nos. 3,876,189; 3,836,131; 3,749,386; 3,591,158; and 2,931,720.

Injection of hot reducing gas into the central portion of a shaft furnace is disclosed in U.S. Pat. Nos. 3,591,158 and 3,450,396.

Injection of cooling gas into the central area of a cooling zone of a shaft furnace is disclosed in U.S. Pat. Nos. 3,836,131; 3,764,123; 3,749,386 and 2,931,720, the latter also disclosing introduction of cooling gas around the periphery of a cooling section.

While the prior art has recognized the desirability of uniform gas distribution both in the reducing zone and cooling zone, in order to achieve uniform ore reduction and uniform cooling of reduced ore to a temperature below that at which reoxidation would occur upon discharge into air, the various expedients and structures exemplified in the patents referred to above do not contemplate nor inherently provide uniform solids flow which, in accordance with the present invention, is the basis from which uniform gas distribution and treatment time of ore particles are derived. In fact, U.S. Pat. No. 3,836,131 provides a complex gas distribution device which is intended to vary the time during which differentially moving particles are subjected to cooling gas in order to compensate for lack of uniformity in solids flow. It thus seems evident that prior art workers have proceeded in a direction directly opposite to that of the present invention.

SUMMARY

It is a principal object of the present invention to provide a furnace structure and means for introducing reducing gas and cooling gas thereinto, which insures uniform solids flow in the reducing and cooling zones, thereby facilitating uniform distribution of reducing and cooling gases among the sized ores and uniform contact time of such gases therewith.

According to the invention there is provided, in a gravity feed shaft type furnace having an uppermost feed section, a reducing zone, a cooling zone and a discharge zone, the improvement comprising a substantially cylindrical reducing zone communicating directly with a substantially cylindrical cooling zone, an inwardly tapering discharge zone of ellipsoidal cross section, an elongated substantially cylindrical member axially disposed within the furnace and extending upwardly from the discharge zone, through the cooling zone, and terminating in the reducing zone, a conical top secured to said member configured in such manner as to cause uniform movement of sized ores downwardly in the reducing zone, means for injecting heated reducing gas into the bottom of said cylindrical member for upward flow therein, means for distributing the hot reducing gas into the center of the reducing zone adjacent the lower end thereof, means for injecting cooling gas into said cylindrical member whereby to cool the means for distributing the hot reducing gas, means for distributing the cooling gas into the center of the cooling zone adjacent the lower end thereof, and means in the discharge zone for supporting the cylindrical member.

Preferably a conduit is provided to conduct hot reducing gas upwardly within the cylindrical member, and this conduit is surrounded by a concentric sleeve into which cool reducing gas is injected, thereby insuring structural integrity by cooling the outer surface of the conduit.

Hot reducing gas is also injected into the bottom of the reducing zone through a plurality of downwardly inclined peripheral openings in an internal refractory bustle pipe having sufficient strength at reducing temperature to withstand the forces exerted by the downwardly moving sized ores.

Cooling gas is also injected into the bottom of the cooling zone through a peripheral distributor skirt.

Uniform solids flow, commonly referred to as "plug flow," in a direct reduction shaft furnace differs from conventional bin flow theory in two basic respects.

First, the forced (upward) gas flow in a furnace interacts with the solids flow (downward) to change the solids flow patterns, angle of repose and critical wall slope angles. This phenomenon is exemplified in requiring steeper cone angles to obtain plug flow with gas counterflow and an increased ability of solids to flow from under the hot reducing gas inlets in the above mentioned internal bustle pipe. It has further been discovered that the conical top of the axial cylindrical member should have a variable progressively steeper slope to ensure plug flow due to the effect of gas counterflow therearound.

Second, the properties of the sized ores change as the ores move downwardly through the furnace. The particles are initially cohesionless, then change to highly cohesive in the reduction zone, and finally become cohesionless after reduction and cooling. The bulk density also changes during the reduction process. These factors necessitate design considerations not present in standard bin flow.

BRIEF DESCRIPTION OF THE DRAWINGS

Reference is made to the accompanying drawings wherein.

DESCRIPTION OF THE PREFERRED EMBODIMENTS

Figure 1:
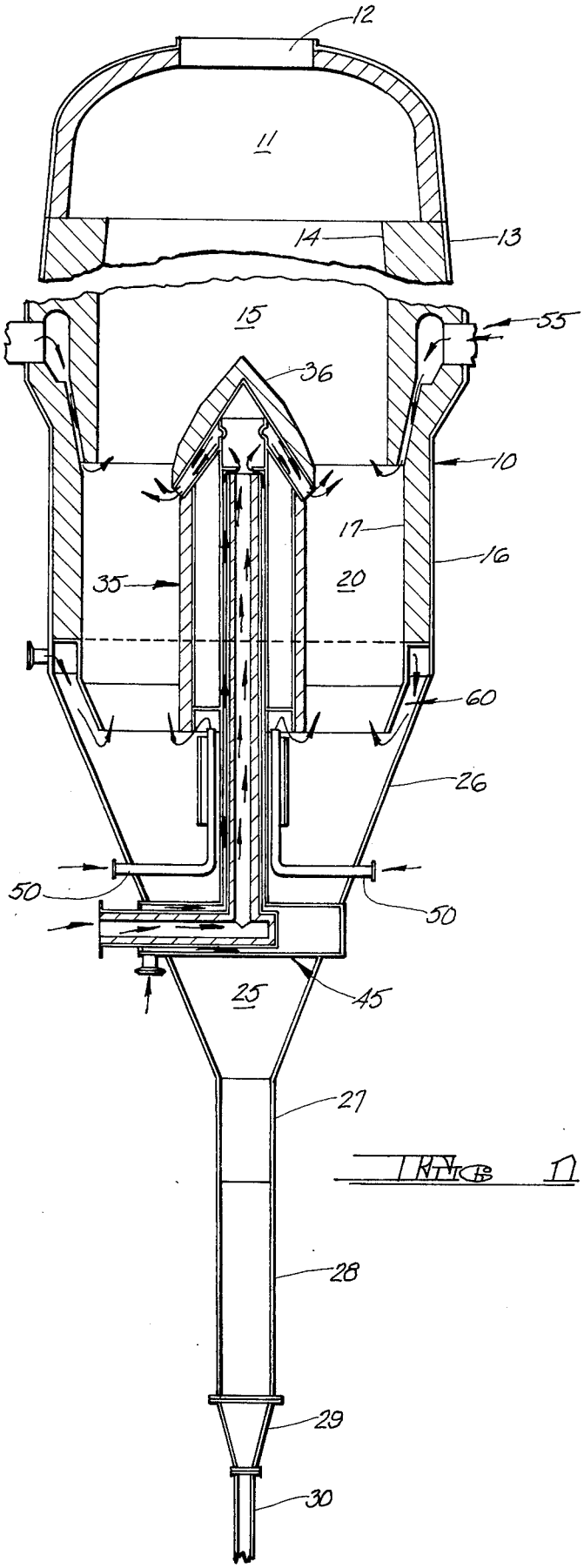
FIG. 1 is a fragmentary vertical sectional view of a direct reduction shaft furnace embodying the present invention.

Referring to FIG. 1 of the drawings, a direct reduction shaft furnace is indicated generally at 10, comprising an uppermost feed section 11, provided with an axial inlet 12 through which sized ores are introduced. The conveying and feeding mechanism is not shown since it forms no part of the present invention. A conduit (not shown) is also provided for removal of spent reducing gas which has passed upwardly through the furnace.

An outer metallic shell 13 and a refractory lining 14 form a substantially cylindrical reducing zone shown generally at 15.

An outer metallic shell 16 and a refractory lining 17 form a substantially cylindrical cooling zone indicated generally at 20, which is in direct communication with the reducing zone.

Referring to FIGS. 1, 3 and 5–7, a discharge zone is shown generally at 25 comprising an ellipsoidal, inwardly tapering transition section 26 communicating directly with cooling zone 20, a breaker bar section 27 of substantially rectangular horizontal cross-section, and further discharge chutes 28, 29 and 30 through which reduced ore descends to conveyor means (not shown) for subsequent processing.

Figure 2:
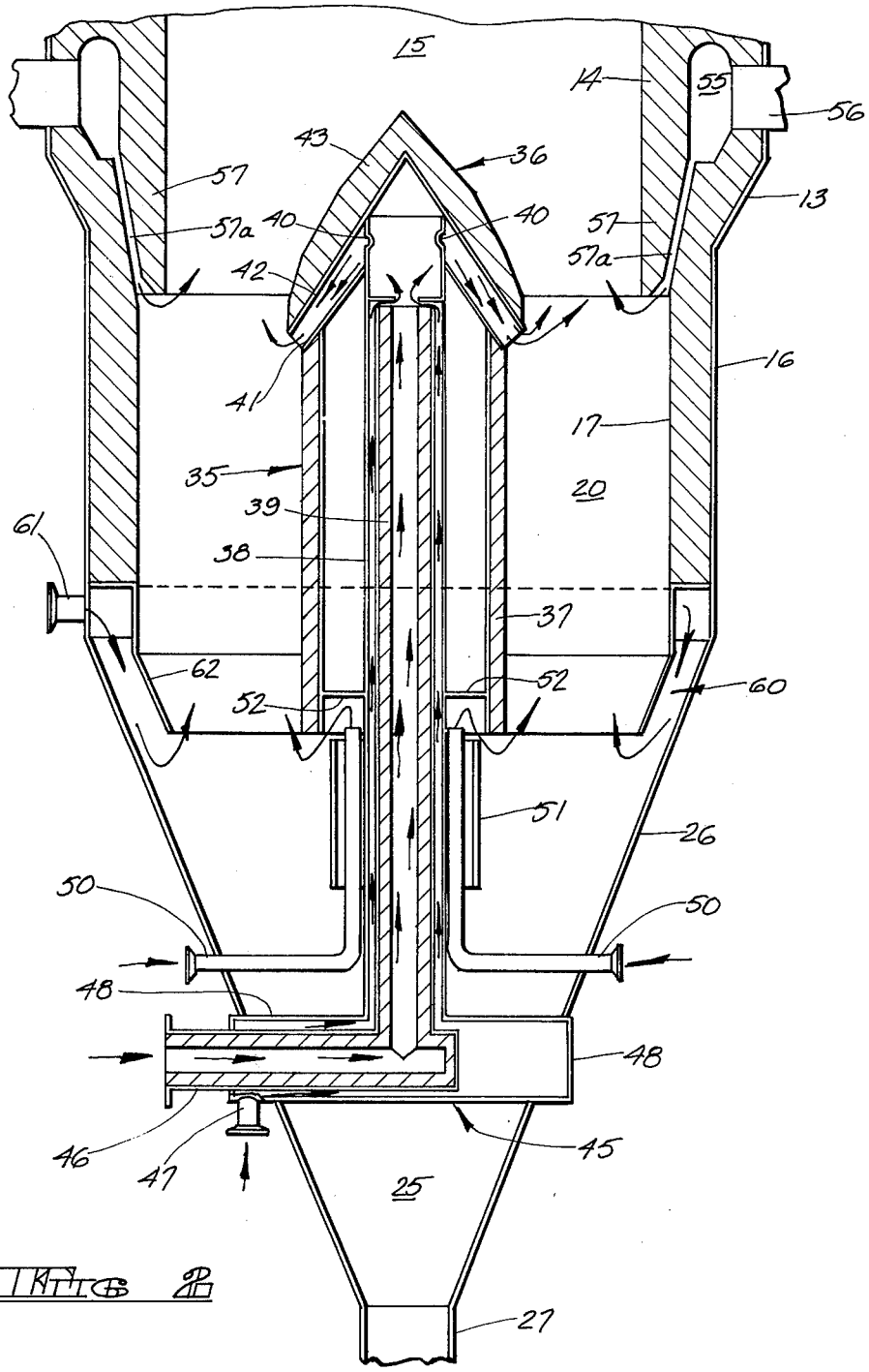
FIG. 2 is an enlarged scale of a portion of FIG. 1.
Figure 7:
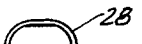
FIG. 7 is a horizontal sectional view taken on the line 7—7 of FIG. 3.
Figure 8:
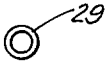
FIG. 8 is a horizontal sectional view taken on the line 8—8 of FIG. 3.
Figure 4:
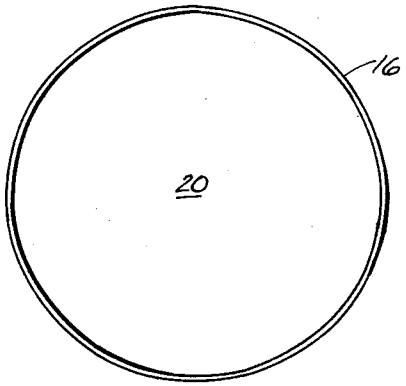
FIG. 4 is a horizontal sectional view taken on the line 4—4 of FIG. 3.
Figure 5:
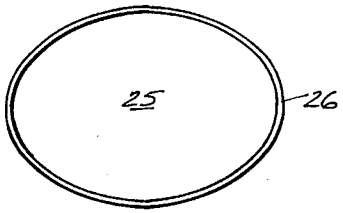
FIG. 5 is a horizontal sectional view taken on the line 5—5 of FIG. 3.
Figure 6:
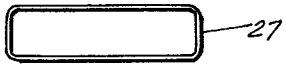
FIG. 6 is a horizontal sectional view taken on the line 6—6 of FIG. 3.
Figure 3:
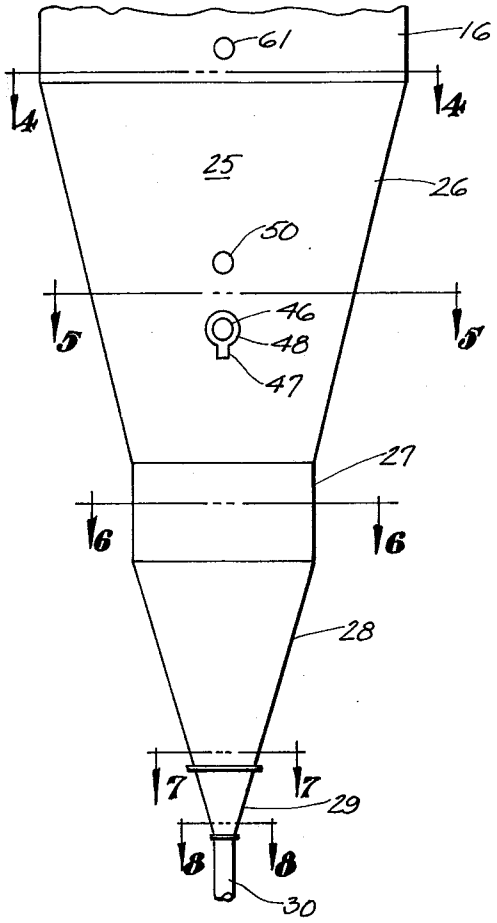
FIG. 3 is a side elevation of the cooling and discharge zones of the shaft furnace of FIG. 1, rotated 90° to the plane of FIG. 1.

Referring to FIGS. 1 and 2, an elongated substantially cylindrical member indicated generally at 35 is disposed axially within the furnace and extends upwardly from the section 26 of discharge zone 25 throughout the cooling zone 20 to terminate in reducing zone 15 in a generally conical top 36, the maximum diameter of which is greater than that of the cylindrical portion of member 35. As will be explained in more detail hereinafter, the top 36 has a variable slope, becoming progressively steeper from the top to the bottom thereof, in correspondence to the changing gas velocity profile over the surface thereof.

As best seen in FIG. 2 the member 35 comprises an outer cylindrical shell or housing 37 which may be covered with a refractory material for abrasion resistance. Within the outer shell 37 there is provided a pair of tubes 38 and 39 concentric with shell 37 and with an annular space therebetween. The tubes 38 and 39 extend downwardly beyond shell 37 to terminate in a support to be described hereinafter in the cool discharge section of the furnace. The inside surface of tube 39 is preferably lined with refractory material for conducting hot reducing gas and terminates in an open end adjacent the lower portion of the top 36. The surrounding tube 38 extends above the top of tube 39 and is provided with a plurality of radially disposed outlets 40. Cool reducing gas is introduced into the annular space between tubes 38 and 39 thus tempering the hot reducing gas and maintaining the temperature of the structure within allowable design limits. The cool temper gas and hot reducing gas mix and pass through outlets 40 into a plurality of downwardly inclined annular passages or distributor formed between members 41 and 42. Member 42 is a conical metallic element on which is formed a refractory coating 43 for abrasion resistance. As indicated previously, the outer surface of the refractory material 43 has a conical tip of about 45° which becomes progressively steeper and approaches vertical at the lowermost end thereof adjacent the distributor for the mixed temper gas and hot reducing gas.

The arrangement described above thus introduces tempered reducing gas into the axial portion of the reducing zone at the lowermost end thereof which passes upwardly with a changing gas pressure gradient over the refractory surface 43 and is heated in passage upwardly through the reducing zone. Accordingly, the cool temper gas introduced in the annular space between tubes 38 and 39 becomes heated reducing gas.

Support means for the cylindrical member 35 is indicated generally at 45 and is disposed across the ellipsoidal transition section 26 in a cool area of the furnace, thus insuring structural integrity. The support means includes an inlet 46 for hot reducing gas communicating with tube 39, an inlet 47 for cool temper gas communicating with a plenum member 48 which in turn communicates with the annular space between tubes 38 and 39. The plenum chamber 48 is of sufficient length to project outwardly on both sides of the ellipsoidal member 26 and is secured thereto as by welding, thereby providing rigid support for the upwardly projecting cylindrical member 35 and top 36.

Additional cooling gas inlets are provided at 50, two being shown by way of example in FIGS. 1 and 2. These inlets project upwardly and are surrounded adjacent the upper portion thereof by a sleeve 51. The inlets 50 terminate adjacent the lowermost portion of the shell or housing 37, and baffles 52 are provided extending between housing 37 and tube 38 which deflect the cooling gas downwardly and outwardly to rise in the central portion of the cooling zone. There is thus a uniform distribution of cooling gas into the cooling zone around the base of the shell 37.

An internal refractory bustle pipe is indicated generally at 55. This includes a plurality of inlets 56 for hot reducing gas, two being shown by way of example in FIGS. 1 and 2, and a plurality of specially-keyed refractory shapes 57 which are designed to have sufficient lateral strength despite the reducing zone temperatures to withstand the forces generated by the decending ore particles. A plurality of peripherally disposed openings **57*a* is provided in the refractory shapes 57 through which hot reducing gas is introduced uniformly around the outside of the reducing zone at the lowermost edge thereof. It is thus apparent that reducing gas is introduced both peripherally and centrally of the reducing zone to provide a uniform upward flow throughout the entire cross-section thereof. Since the top 36** of the cylindrical member is sized and positioned in such a way as to cause plug flow of solids in the reducing zone, it is evident that optimum reducing conditions are provided.

Additional cooling gas is introduced peripherally at the lowermost edge of the cooling zone through a cooling gas distributor skirt, indicated generally at 60 in FIGS. 1 and 2. This comprises an inlet 61 for cool gas and a downwardly depending inwardly tapered peripheral metallic skirt 62 generally parallel to the ellipsoidal transition section 26. This provides a continuous peripheral passageway through which cooling gas passes downwardly and outwardly into the cooling zone.

In the preferred practice of the invention the cooling gas introduced through inlets 47 and 50 is cleaned and cooled top gas which has been withdrawn from the upper portion 11 of the furnace after passage through the reducing zone. Typically it will be at a temperature of about 40° C, and in passage through the cooling zone 20 it removes sensible heat from the reduced ore, reaching a temperature of about 650° to 900° C by the time it passes into the reducing zone 15. It then becomes a part of the reducing gases in the reducing zone. The reduced ore passes downwardly through the discharge section 25 after being cooled to a temperature not greater than about 95° C.

Hot reducing gases introduced through inlets 46 and 56 are at a temperature of about 650° to about 930° C. Reference may be made to U.S. Pat. No. 3,905,806 for a description of the composition and manner of generation of the hot reducing gas.

In an exemplary installation having a design capacity of 1200 metric tons of reduced ore per day, the overall height of the furnace from the top to the point of discharge of reduced product is 36.58 meters. The maximum inside diameter of the reducing zone is 5.03 meters, while the maximum inside diameter of the cooling zone is 5.64 meters. The top 36 of the cylindrical member 35 has a maximum diameter of 2.44 meters. The length of the cooling section 20 is 4.57 meters.

The size and configuration of the cylindrical member 35 and its top 36 were derived both by experimental and theoretical determinations. These determinations were based on a number of design criteria, the principal ones being as follows:

In the upper portion of the reducing zone the ore must move with a uniform velocity pattern so that gas and solids stream lines coincide. The region must be of sufficient length to provide the necessary retention time for heat transfer and the reduction reactions.

At the bottom of the reducing zone where hot reducing gas is introduced, solids must flow past the internal refractory bustle pipe continuously so that no dead regions form at or above the inlets. The inlet area must be sufficiently large to eliminate any severe localized fluidization of the ore particles which would cause hang-up of particles or channeling of the gas. The distribution of hot reducing gas must be sufficiently uniform as to cause coincidence of the gas and solids stream lines a short distance above the inlets.

In the cooling zone solids and gas flows must be as uniform as possible so as to provide the most efficient and most uniform cooling possible. The length of the cooling zone must be sufficient for cooling lumps of reduced ores down to about 95° C at the rated output of the reducing zone.

Gas velocity in the entire cooling zone must be uniform.

At the bottom of the cooling zone where cooling gas is introduced, non-flowing solids regions must be eliminated, and uniform solids flow must be maintained.

In the discharge section no chemical reactions occur, but the design thereof must be such as to produce uniform solids velocity, to crush agglomerates of reduced ore which may have formed, and to mechanically seal the pressurized gases in the furnace from atmosphere.

By solution of a complex series of mathematical equations, in which experimental findings and certain assumptions were applied, the furnace described above was developed and satisfied the design criteria.

While the invention has been described in its preferred embodiments, modifications may be made without departing from the scope of the invention, and hence no limitations are to be inferred except insofar as specifically set forth in the claims which follow.

The embodiments of the invention in which an exclusive property or privilege is claimed are defined as follows:

1. In a gravity feed shaft-type furnace for the reduction of sized iron ores having a feed zone, a reducing zone, a cooling zone and a discharge zone, the improvement comprising a substantially cylindrical reducing zone communicating directly with a substantially cylindrical cooling zone, an inwardly tapering discharge zone of generally ellipsoidal cross section, an elongated substantially cylindrical member axially disposed within said furnace and extending upwardly from said discharge zone through said cooling zone and terminating in said reducing zone, a conical top secured to said member and configured in such manner as to cause uniform movement of sized ores downwardly in said reducing zone, means for introducing hot reducing gas into the bottom of said cylindrical member for upward flow therein, means for distributing said hot reducing gas into the center of the reducing zone adjacent the lower end thereof, means for introducing cooling gas into said cylindrical member whereby to cool said means for distributing the hot reducing gas, means for distributing said cooling gas into the center of said cooling zone adjacent the lower end thereof, and means in said discharge zone for supporting said cylindrical member.

2. The improvement claimed in claim 1, wherein said means for distributing hot reducing gas into the center of said reducing zone includes a pair of concentric conduits axially disposed within said cylindrical member, the outer one of said pair of conduits having a plurality of outlets adjacent the upper end thereof and adjacent said top, the inner one of said pair of conduits having an open upper end, an annular space between said pair of conduits communicating with said means for injecting cooling gas into said cylindrical member whereby to cool said inner one of said pair of conduits, and a plurality of downwardly inclined annular passages communicating with said outlets around the periphery of the lower edge of said top through which mixed hot and cool reducing gases are introduced into the center of said reducing zone.

3. The improvement claimed in claim 1, including means for introducing hot reducing gas into the lower end of said reducing zone peripherally thereof.

4. The improvement claimed in claim 3, wherein said means for introducing hot reducing gas comprises a plurality of keyed refractory shapes having a plurality of downwardly inclined openings therethrough.

5. The improvement claimed in claim 1, including means for introducing cool gas into the lower end of said cooling zone peripherally thereof.

6. The improvement claimed in claim 5, wherein said means for introducing cooling gas comprises a downwardly depending inwardly tapered metallic skirt generally parallel to said inwardly tapering discharge zone, thereby providing a continuous peripheral passageway.

7. The improvement claimed in claim 1, wherein said means for supporting said cylindrical member includes an inlet for hot reducing gas, an inlet for cool reducing gas, and a plenum chamber extending across said discharge zone and being secured thereto.

8. The improvement claimed in claim 1, wherein said conical top has an abrasion resistant refractory coating with an included angle of about 45° which becomes progressively steeper and approaches the vertical at the lowermost end thereof.

9. The improvement claimed in claim 1, wherein said means for distributing cooling gas into said cooling zone is separate from said means for introducing cooling gas into said cylindrical member.

* * * * *